US009173495B2

(12) United States Patent
Goldszer

(10) Patent No.: US 9,173,495 B2
(45) Date of Patent: Nov. 3, 2015

(54) CHAIR ADJUSTMENT MECHANISM

(71) Applicant: JGR Copa, LLC, Hollywood, FL (US)

(72) Inventor: Jacob Goldszer, Hollywood, FL (US)

( * ) Notice: Subject to any disclaimer, the term of this patent is extended or adjusted under 35 U.S.C. 154(b) by 0 days.

(21) Appl. No.: 14/453,698

(22) Filed: Aug. 7, 2014

(65) Prior Publication Data

US 2014/0346831 A1 Nov. 27, 2014

Related U.S. Application Data

(63) Continuation-in-part of application No. 13/102,783, filed on May 6, 2011, now abandoned.

(51) Int. Cl.

| | |
|---|---|
| ***A47C 1/026*** | (2006.01) |
| ***A47C 4/00*** | (2006.01) |
| ***A47C 4/18*** | (2006.01) |

(52) U.S. Cl.

CPC ..... *A47C 4/00* (2013.01); *A47C 1/0265* (2013.01); *A47C 4/18* (2013.01)

(58) Field of Classification Search

CPC ..... A47C 1/024; A47C 1/026; A47C 1/0265; A47C 1/03238; A47C 1/03244; A47C 1/14; A47C 4/00; A47C 4/18

See application file for complete search history.

(56) References Cited

U.S. PATENT DOCUMENTS

| | | | | |
|---|---|---|---|---|
| 380,525 | A | 4/1888 | Schmuck | |
| 2,920,686 | A | 1/1960 | Morton | |
| 3,037,811 | A | 6/1962 | Vanderminden | |
| 3,075,811 | A * | 1/1963 | Brown | A47C 1/0265 297/359 |
| 3,135,551 | A | 6/1964 | Andreoli et al. | |
| 3,191,958 | A | 6/1965 | Smith | |
| 3,368,594 | A | 2/1968 | Cohen | |
| 3,627,342 | A | 12/1971 | Morellet et al. | |
| 3,677,571 | A | 7/1972 | Maturo, Jr. et al. | |
| 3,693,993 | A | 9/1972 | Mazzarelli et al. | |
| 4,055,357 | A | 10/1977 | Sorocin | |
| 4,222,585 | A | 9/1980 | Crothers | |
| 4,266,807 | A | 5/1981 | Griffin | |
| 4,429,897 | A | 2/1984 | Friedman et al. | |
| 4,674,793 | A | 6/1987 | Kettler | |
| 4,703,944 | A | 11/1987 | Higson | |
| 4,784,432 | A * | 11/1988 | Brown | A47C 1/0265 297/28 |
| 4,790,559 | A | 12/1988 | Edmonds | |
| 4,865,346 | A | 9/1989 | Carlile | |
| 4,887,837 | A | 12/1989 | Bonewicz, Jr. et al. | |
| 4,898,421 | A * | 2/1990 | Brunn | A47C 1/0265 297/28 |
| 4,906,046 | A | 3/1990 | Kleinklaus | |
| 5,197,754 | A | 3/1993 | Ward | |
| D338,791 | S | 8/1993 | Cohen | |

(Continued)

*Primary Examiner* — Philip Gabler
(74) *Attorney, Agent, or Firm* — Robert C. Kain, Jr.

(57) ABSTRACT

The chair adjustment mechanism, attached beneath a chair arm, has a housing and four walls forming an interior closed space. A closing bottom wall has a longitudinal guide slot. A longitudinal continuous serpentine adjustment cam surface. A cam follower on an adjustment plate moves on the cam surface in the interior space. The adjustment plate movably extends through the guide slot in a close fit and substantially closes the guide slot thereat. In one embodiment, each sidewall defines an opposing cam surface and a pair of cam followers extend laterally from an upper region of the adjustment plate. The lower plate extends outward from the slot and is preferably attached to two chair legs. The adjustment plate moves vertically, first out from the depending cam ridges, then the plate and cam follower moves longitudinally, and then moves vertically into a different intersection between adjacent depending cam ridges.

22 Claims, 10 Drawing Sheets

(56) References Cited

U.S. PATENT DOCUMENTS

| | | | | |
|---|---|---|---|---|
| D376,060 | S | 12/1996 | Cohen | |
| 5,915,722 | A | 6/1999 | Thrasher et al. | |
| 5,988,671 | A | 11/1999 | Abelbeck et al. | |
| 6,502,899 | B2 * | 1/2003 | Tseng | A47C 7/54 297/28 |
| 6,739,652 | B2 | 5/2004 | Welsh | |
| RE39,022 | E | 3/2006 | Welsh et al. | |
| D547,981 | S | 8/2007 | Cohen | |
| D552,386 | S | 10/2007 | Cohen | |
| 7,374,247 | B2 | 5/2008 | Welsh et al. | |
| D571,113 | S | 6/2008 | Cohen | |
| D571,115 | S | 6/2008 | Cohen | |
| D599,972 | S | 9/2009 | Goldszer | |
| D630,834 | S | 1/2011 | Cohen | |
| 2004/0206790 | A1 | 10/2004 | Welsh | |
| 2012/0280549 | A1 * | 11/2012 | Goldszer | A47C 4/00 297/359 |

* cited by examiner

CHAIR ADJUSTMENT MECHANISM

This is a continuation in part patent application claiming the benefit of U.S. patent application Ser. No. 13/102,783, filed May 6, 2011, now pending, the contents of which is incorporated herein by reference thereto.

The present invention relates to adjustment mechanisms for adjustable or foldable chairs.

BACKGROUND OF THE INVENTION

Adjustment mechanisms for adjustable or foldable chairs permit a portion of the chair to be positioned in a selected one of a number of different positions, or may simply permit the chair to be folded into a collapsed position. Such adjustment mechanisms need to be reliable in operation, provide ease of adjustment, permit relatively flat folding of the chair, and be relatively inexpensive to manufacture and easy to assemble. Prior art adjustment mechanisms that meet many or all of the desirable design characteristics described above, often expose the interlocking engagement surfaces of the mechanism, which can create a pinch hazard during folding, unfolding or adjustment of the chair.

Adjustment mechanisms on prior art folding chairs typically have large open slot channels through which extends the bars or leg tubes attached to the movable chair legs or components. These large open channels may cause injury to users if the user's fingers get caught in the large open channels.

SUMMARY OF THE INVENTION

A need exists for adjustment mechanisms for chairs, or other objects, which meet a significant number of the desirable design characteristics and also provide improved shielding of the interlocking surfaces or components of the adjustment mechanism. In some embodiments, the present adjustment mechanisms provide improved pinch protection while also allowing a flat configuration upon folding, ease of adjustment, and relatively inexpensive and easy manufacture and/or assembly.

The chair adjustment mechanism is attached beneath a chair arm rest. The adjustment mechanism includes a housing, attached beneath the chair arm rest, having a forward wall, a rearward wall and a pair of opposing side walls extending between the forward and rear walls and a bottom wall. These walls collectively define, in conjunction with the chair arm rest, an interior closed space. The bottom wall has a single guide slot therein extending longitudinally in the housing and the slot has a predetermined lateral slot width. The housing also defines, in an interior closed space, a longitudinal continuous serpentine adjustment surface. The serpentine adjustment surface has, at least, first and second longitudinally spaced apart adjustment surface segments. The serpentine adjustment surface defines a cam surface for a cam follower on an adjustment plate which adjustment plate movably extends through the guide slot.

The adjustment plate has an upper plate region extending into the interior closed space and a lower plate region extending below the bottom wall of the housing. The upper and lower adjustment plate regions are planar as is the entire adjustment plate (a single thickness plate of metal, preferably). The adjustment plate has a thickness which is complementary to the guide slot lateral width such that the adjustment plate substantially closes the guide slot thereat.

The cam follower is formed on or in the upper plate region. The cam follower moves over the serpentine cam surface as the adjustment plate moves longitudinally within the interior closed space. In one preferred embodiment, each sidewall of the housing defines an opposing longitudinal continuous serpentine adjustment surface and a pair of cam followers extend laterally form the adjustment plate upper region and coact with the serpentine adjustment surface.

The lower plate region extends outward from the guide slot and is configured to be attachable to a component of the chair. In one preferred embodiment, the adjustment plate is fixed to one chair leg and is pivotally mounted to the other chair leg.

The adjustment plate is movable between a first vertical position and a second vertical position relative to the housing. In the first vertical position, the adjustment plate is able to move in the longitudinal direction from one side of the serpentine cam surface to the other side of the serpentine cam surface. In the second vertical position, the cam follower and the adjustment plate is able to engage either one of a first and a second adjustment surface segment to selectively adjust a longitudinal position of the adjustment plate relative to the housing. In the illustrated embodiment herein, four longitudinal adjustment positions (first, second, third and fourth positions) are provided by four depending cam surface ridges, which ridges depend or extend downward into the closed interior space of the housing.

The illustrated embodiment includes a plurality of depending rounded cam ridges, each cam ridge having a rearward-facing substantially vertical cam ridge section and a forward-facing angled cam ridge section. The release of the adjustment plate and cam follower from an intersection of a respective angled cam ridge section and an adjacent vertical cam ridge section requires adjustment plate movement between the first vertical position and the second vertical position. The cam follower moves vertically away from the intersection at the joint between the angled cam ridge section and the adjacent vertical cam ridge section. The intersection may define a rounded cam ridge rest section.

The forward-most angled cam ridge may terminate in a rearward-facing loop cam surface. The first and the second adjustment surface segments are, in one embodiment, formed by a respective rearward-facing substantially vertical cam ridge section, the corresponding intersection and the corresponding adjacent angled cam ridge section. The angled cam ridge section may define an acute angle with respect to one or more vertical cam ridge sections.

BRIEF DESCRIPTION OF THE DRAWINGS

These and other features, objects, aspects and advantages of the present chair adjustment mechanism are described herein with reference to drawings of preferred embodiments, which are provided for the purpose of illustration and not for limitation.

DETAILED DESCRIPTION OF THE EMBODIMENTS

The present invention is related to a chair adjustment mechanism for a folding chair. The adjustment mechanisms disclosed herein are well-suited for use in an adjustable chair to permit adjustment of a position of one portion of the chair relative to another portion of the chair. In the illustrated arrangements, the chair is foldable or collapsible and the adjustment mechanism permits an arm of the chair to be adjusted relative to a frame of the chair. Preferably, adjustment of the arm of the chair adjusts a recline position of a back of the chair. In addition, preferably, an adjustment mechanism is provided on each of the arms of the chair. However, the adjustment mechanism can be used to permit adjustment of other features of a chair and/or can be provided in other locations or between other portions of the chair.

The adjustment mechanisms are disclosed herein in the context of an adjustable or foldable chair, which can be unfolded and positioned on a surface. See FIG. 1. The chair can also be folded into a generally flat configuration. See FIG. 9. The adjustment mechanisms are often described herein using relative terms, such as forward, rearward, above, below, upper, lower, left and right. These terms are used for convenience and usually in the context of the specific figure(s) being described, unless otherwise noted or apparent from the context.

Figure 1:
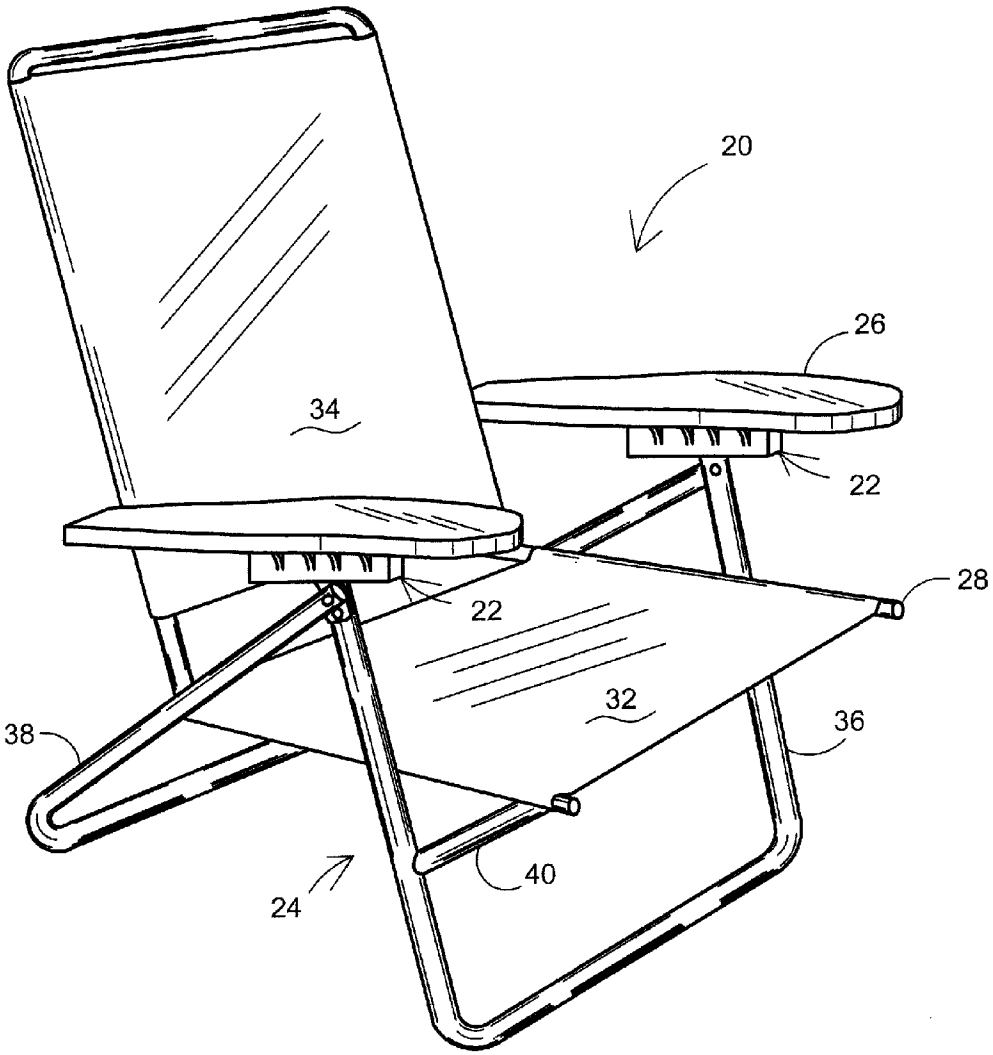
FIG. 1 is a perspective view of an adjustable chair including a pair of adjustment mechanisms having certain features, aspects and advantages of the present invention.

FIG. 1 illustrates a foldable, adjustable chair 20 that includes at least one adjustment mechanism 22. The illustrated chair 20 includes a pair of adjustment mechanisms 22 on each side of the chair 20. The adjustment mechanism 22 permits adjustment of one component or portion of the chair 20 relative to another component or portion of the chair 20. The illustrated chair 20 includes a frame 24 and a pair of armrests or arms 26 supported by or relative to the frame 24 and extending in a fore-aft direction on each side of the chair 20. The frame 24 can include a seat frame portion 28 and a backrest or back frame portion 30. The seat frame portion 28 can support or define a seat portion 32 of the chair 20 and the back frame portion 30 can support or define a backrest 34 of the chair 20. The seat frame portion 28, seat portion 32, back frame portion 30 and backrest 34 can be of any suitable construction. For example, each one or a combination of several of these components can be constructed of a unitary piece of material. In other arrangements, the frame portions 28, 30 can be of a rigid material (e.g., metal or plastic, rod or tubular) construction and the seat 32 and backrest 34 can be constructed of a fabric (or other suitable material) panel or plurality of panels or strips that extend between or are supported by the frame portions 28, 30.

The frame 24 preferably also includes at least one front leg portion 36 and at least one rear leg portion 38. The front leg portion 36 and rear leg portion 38 can be of any suitable construction. For example, one or both of the front leg portion 36 and rear leg portion 38 can include multiple legs. That is, the chair 20 can include two (or more) front legs and two (or more) rear legs, which may or may not be coupled to one another. However, in the illustrated arrangement, the front leg portion 36 includes a generally U-shaped frame portion, and can include one or more cross supports 40. Similarly, the illustrated rear leg portion 38 includes a generally U-shaped frame portion, and can include optional cross supports (not shown). The front leg portion 36 and rear leg portion 38 support the seat frame portion 28, seat portion 32, back frame portion 30 and backrest 34.

In addition, the front leg portion 36 and the rear leg portion 38 preferably are pivotally coupled to one another at or near their upper ends (free ends of the U-shaped frame portions). Accordingly, the front leg portion 36 and the rear leg portion 38 can fold relative to one another. Preferably, the front leg portion 36 and the rear leg portion 38 can fold one inside the other such that the frame portions are positioned side-by-side in a lateral direction, thereby minimizing the thickness of the folded leg portions 36, 38 in the folded configuration. In the illustrated arrangement, the front leg portion 36 has a smaller lateral dimension than the rear leg portion 38 so that the front leg portion 36 is positioned within the rear leg portion 38. However, this orientation could also be reversed. Furthermore, preferably the seat portion 32 and backrest 34 are pivotally connected and can fold relative to one another so that the entire chair 20 can fold in a manner well known to those in the art.

Figure 2A:
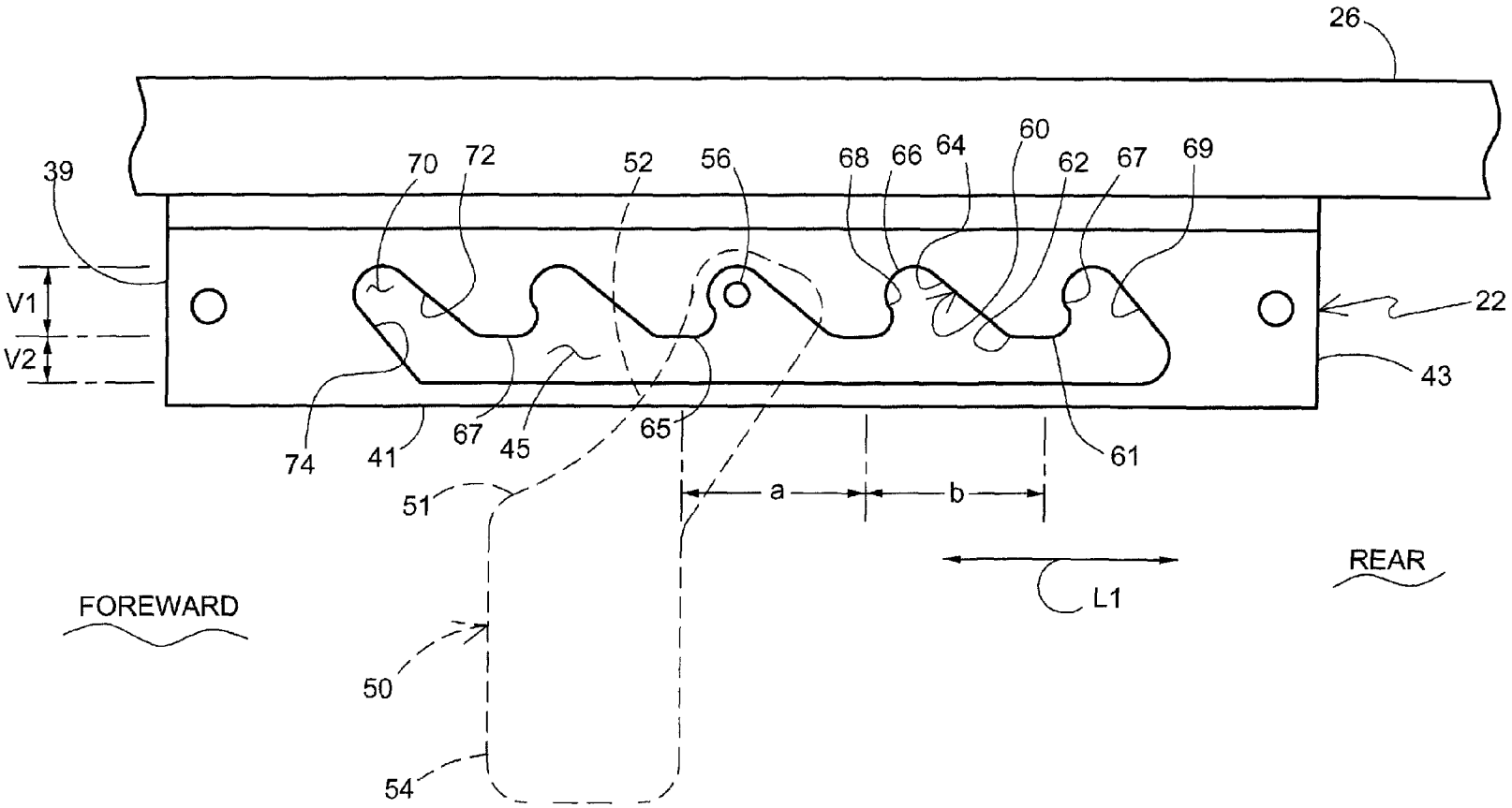
FIG. 2A diagrammatically illustrates the adjustment mechanism 22 mounted beneath chair arm rest 26 (also showing one-half of the serpentine adjustment surface formed on the far sidewall, wherein the near sidewall also forms portions of the serpentine adjustment surface in the preferred, illustrated embodiment)
Figure 2B:
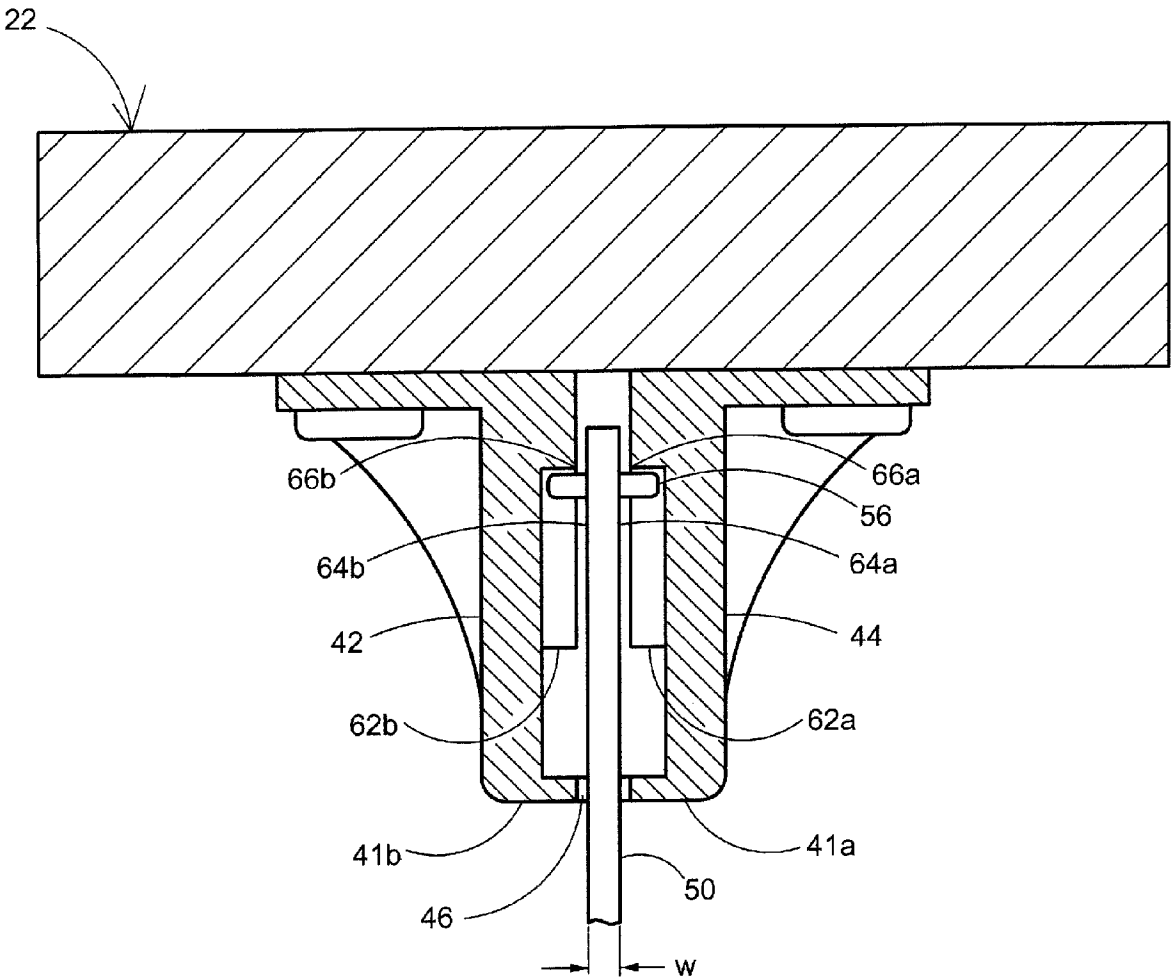
FIG. 2B diagrammatically illustrates a cross sectional view of the adjustment mechanism 50 and, more particularly, the upper plate region of the adjustment arm forming a cam follower 56 which coacts with the serpentine adjustment surface formed by the far sidewall and the near sidewall, in the preferred embodiment.
Figure 3:
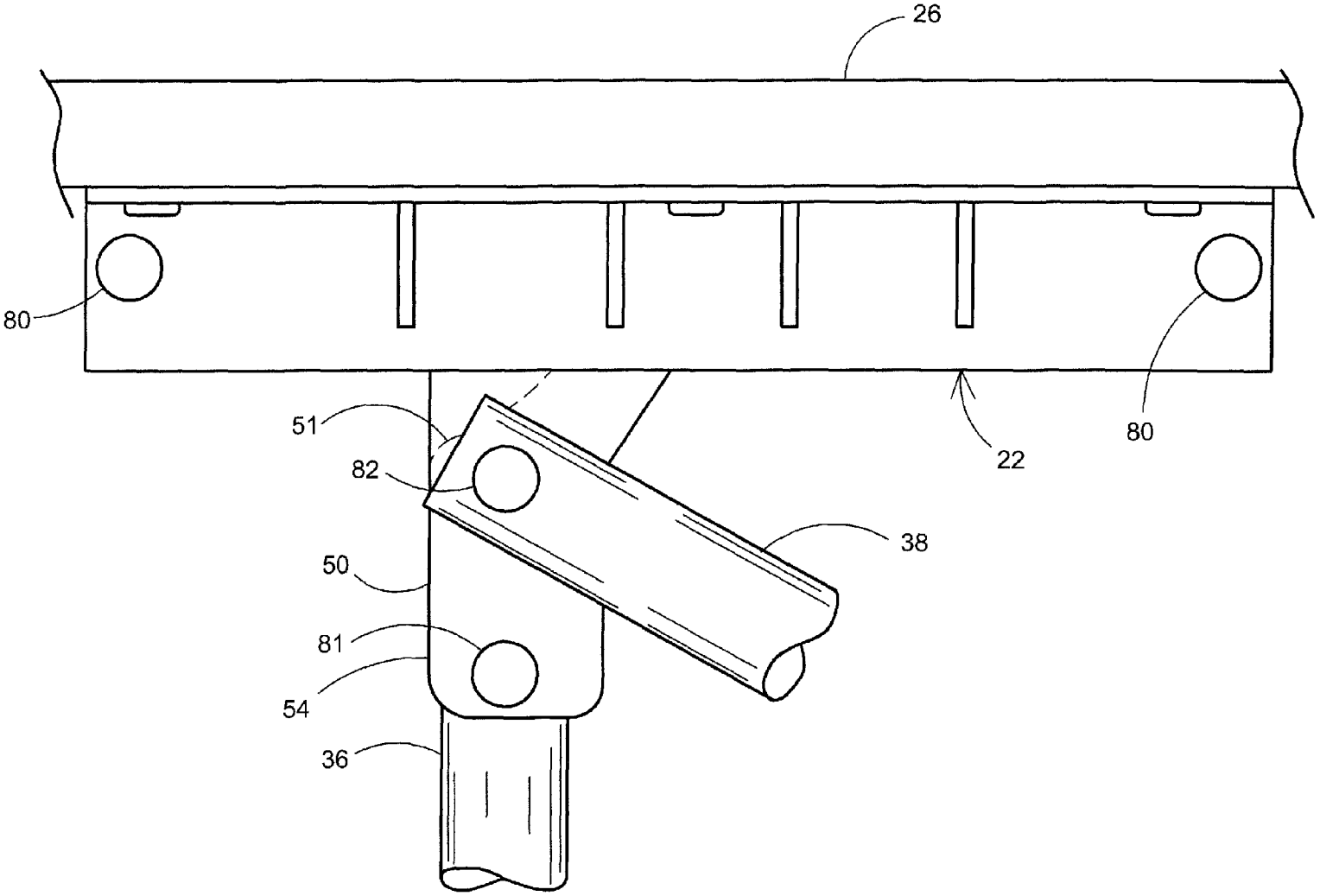
FIG. 3 diagrammatically illustrates a side view of the adjustment mechanism connected to components of the folding chair.

FIG. 2 diagrammatically illustrates a preferred embodiment of the adjustment mechanism 22. Adjustment mechanism 22 includes a forward wall 39, a rearward wall 43, and two opposing sidewalls 42, 44 (which walls 42, 44 are best shown in FIG. 2B). FIGS. 2A and 2B are discussed concurrently herein. In FIG. 2A, the interior of the far sidewall 42 is shown wherein an interior closed space 45 is created between sidewalls 42, 44 as shown in FIG. 2B. Additionally, adjustment mechanism 22 has a housing formed by bottom wall 41. As shown in FIG. 2B, bottom wall 41 is formed in two segments (preferred embodiment), identified as bottom wall 41*a* and 41*b*. Opposing sidewalls 42, 44, form along a bottom edge, a single guide slot 46 through which extends adjustment plate 50. As shown in FIG. 3, adjustment plate 50 is pivotally attached to one of the chair elements or legs 38 and is generally fixed to the second chair element 36 (preferred embodiment).

Adjustment plate 50 consists of a single planar plate (see FIGS. 2B and 4) and includes an upper plate region 52 and a lower plate region 54. The upper plate region 52 extends through guide slot 46 and the lower plate region 54 depends below the bottom wall 41 and is configured to be attached to one or more components of the chair. Additionally, adjustment plate 50 includes a cam follower 56 on or in the upper plate region 52 of plate 50. In a preferred embodiment, cam follower 56 is a pair of laterally extending pins that extend beyond the plane of plate 50. See FIG. 2B. However, the cam follower 56 may be a single pin or button extending on one side of the plate. Otherwise, the plate could be configured with a T-shaped cam follower at the upper edge of upper plate region 52. The laterally extending T legs will coact with the serpentine adjustment cam surface 60 formed in the interior space 45 of the housing. The housing for adjustment mechanism 22 includes forward and aft walls 39, 43, and bottom wall 41. The top of closed space 45 is either a top wall of the housing or the lower surface of the chair arm.

The housing defines an interior closed space 45 and a longitudinal continuous serpentine adjustment surface 60. The serpentine adjustment surface has at least a first and a second longitudinal space adjustment surface segments generally designated as segments "a" and "b" in FIG. 2A. In general, cam follower 56 moves along cam surface 60 and provides various adjustment positions based upon the longitudinal position of cam follower 56 and further based upon the vertical position of cam follower 56 in space 45. Vertical positioning is explained later.

In the preferred embodiment, the continuous serpentine adjustment surface 60 includes a plurality of depending rounded cam ridges 61, 63, 65 and 67. In the illustrated embodiment, four cam ridges are illustrates.

In FIG. 2A, adjustment mechanism 22 has cam ridges 61, 63, 65 and 67. The cam ridges depend into substantially closed interior space 45. Interior space 45 is substantially closed other than a small singular slot 46 is formed in the bottom walls by bottom wall segment 41*a*, 41*b* as shown in FIG. 2B. Adjustment arm 50 closes the slot 46.

Cam ridge 61 includes a ridge top 62, an angled cam ridge section 64 and a rearward facing substantially vertical cam ridge section 67. Additionally, the forward facing angled cam ridge section 64 has an intersection 66 with an adjacent vertical cam ridge section 68. Cam follower 56 is adopted to ride along forward facing angled cam ridge section 64 into the resting space or adjustment position at the intersection 66 of angled cam ridge section 64 and substantially vertical cam ridge section 68. In addition to longitudinal adjustment positions at the various intersections between the forward facing angled cam ridge sections and the adjacent rearward facing vertical cam ridge sections, the adjustment mechanism 22 permits vertical movement of the adjustment plate 50 and the attached cam follower 56 within the space 45. A first vertical position region is shown as V2 in FIG. 2A. In the first vertical position when cam follower 56 is in the vertical space V2 of interior closed space 45, the adjustment plate and the cam follower 56 can move longitudinally in the direction shown by the double arrow line L1 in a longitudinal direction from one side of the adjustment mechanism to the other side (between the interior surfaces of walls 39, 43). In the second vertical position designated by V1 in FIG. 2A, the cam follower 56 engages in at least a first or a second adjustment surface designated by the intersections of the vertical cam ridge sections 68 and the angled cam ridge sections 64. As shown in FIG. 2A, cam follower 56 is in the intersection between depending cam ridges 63, 65. The cam ridges depend down into closed space 45. A second adjustment in the second vertical position would be at intersection 66 of the serpentine surface 60.

One important feature (of the several important features) of the present invention is the thickness of adjustment plate 50 and the lateral width 46 of the single guide slot in the bottom wall 41*a*, 41*b* of the housing defining adjustment mechanism 22. The thickness of plate 50 is substantially the same as the lateral space defined by guide slot 46. Therefore, the probability of a user's finger intruding into guide slot 46 is greatly reduced, if not eliminated, because the plate is less than ⅛ inch and the slot is nearly the same width. However, even though the plate 50 has a complementary thickness compared to the lateral span of guide slot 46, the plate can move longitudinally in the direction L1 from a forward position to a rearward position within closed interior space 45.

In the illustrated embodiment of FIG. 2A, certain hollowed out portions of the inboard sidewall 41 have been removed. Compare FIG. 2A to FIG. 6.

Although FIG. 2A shows at least three chair adjustment positions defined at the intersection of depending cam ridges 61, 63 and 65, the chair mechanism also has a forward adjustment position wherein the forward most cam ridge 67 terminates in a rearward facing loop cam surface 74. The rearward facing loop cam surface 74 forms a complementary angled cam surface which is complementary to the adjacent angled cam ridge section 72.

On the rearward side, a rearward facing vertical cam section 67 defines another chair position which terminates an forward facing angled cam section 69.

The forward facing and angled cam ridge sections 69, 64 are generally at an acute angle with respect to a vertical centerline passing through the housing of adjustment mechanism 22. The substantially vertical cam ridge sections 67, 68 are substantially vertical but may be slightly offset from a vertical centerline of the housing for adjustment mechanism 22.

Although the preferred embodiment has an inboard wall 41 and an outboard wall 44, respectively forming the inboard lateral segment of the serpentine adjustment surface 60 and the lateral outboard segment of serpentine surface 60, a different construct may be utilized. Rather than a cam follower 56 that extends laterally from both sides of adjustment plate 50, a single lateral pin extending from one planar surface of adjustment plate 50 may be utilized. In that situation, only one of the sidewalls would define the serpentine adjustment surface 60. The other sidewall could be vertical to support the operations of the adjustment plate 50. The vertical sidewall would coact with the vertical upper region 52 of plate 50.

FIG. 2B shows the depending crest of the cam ridge 60 by serpentine cam surfaces 62*a*, 62*b*. Sidewall cam surfaces 62*a*, 62*b* are mirror images of each other as is the remaining cam surfaces. The intersection between cam ridges 61, 63, that is, intersection 66, is shown in FIG. 2B, is formed by lateral surface 66*a* of the sidewall 44. The opposite intersection is cam surface 66*b* formed in the interior of sidewall 42. With two opposite cam surfaces cooperating with two oppositely extending cam followers (see follower 56) and the close fitting plate 50 in slot 46, a stable 3-point mechanical structure is formed with these elements. This mechanical structure limits lateral movement of arm 50 and hence limits lateral movement of chair legs 36, 38. The close fitting plate-in-the-slot and a single cam follower extension (the other side of the plate being planar, without a follower) is less stable, but still operable.

FIG. 3 shows that the adjustment mechanism 22 and the inboard and outboard sidewalls are mounted together by attachments 80. The attachment mechanism 22 is mounted beneath the arm chair rest 26. The bottom surface of the arm chair rest 26 forms the top cover of interior closed space 45. Alternatively, the top wall of the interior space 45 could be formed by mating surfaces of the inboard and outboard portions of the housing for adjustment mechanism 22. In FIG. 3, adjustment plate 50 and more particularly lower plate region 54 is coupled to chair components 36, 38. In the preferred embodiment, chair leg 38 is pivotally coupled to plate 50 and leg 36 is fixed to plate 50. See pivot 82 and fixed mount 81. Plate 50 may have a curved cut-out 51 (see FIG. 2A) or not (See FIG. 3). A mount system 80 (rivets, bolts, screws, etc.) hold the far side and near side wall elements 42, 44 (FIG. 2B) together.

Figure 4:
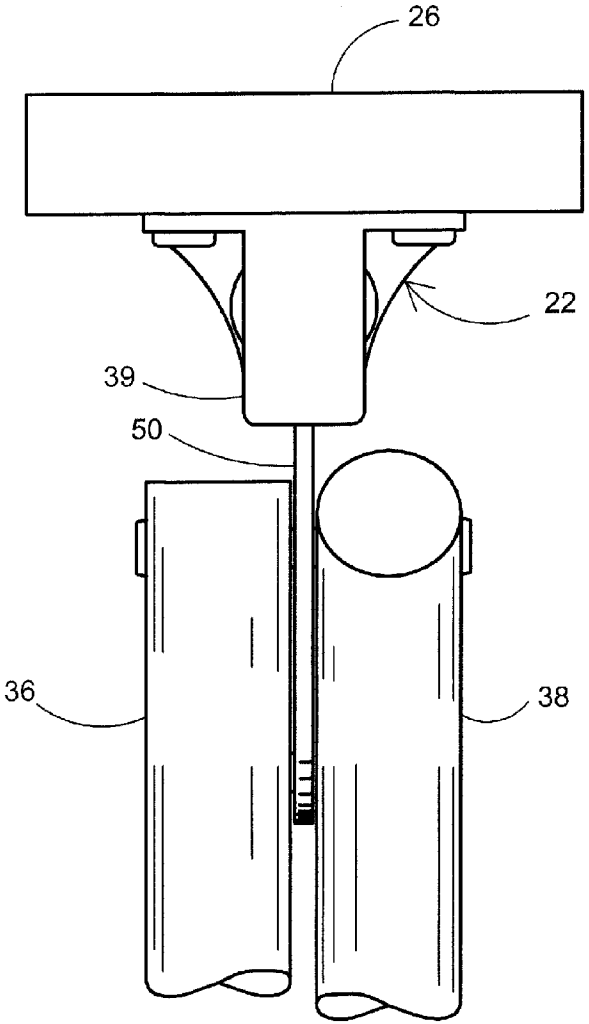
FIG. 4 diagrammatically illustrates a front end view of the adjustment mechanism, the adjustment plate 50 and the attached components of the folding chair.

FIG. 4 shows a front end view of plate 50, legs 36, 38 and adjustment mechanism 22.

Figure 5:
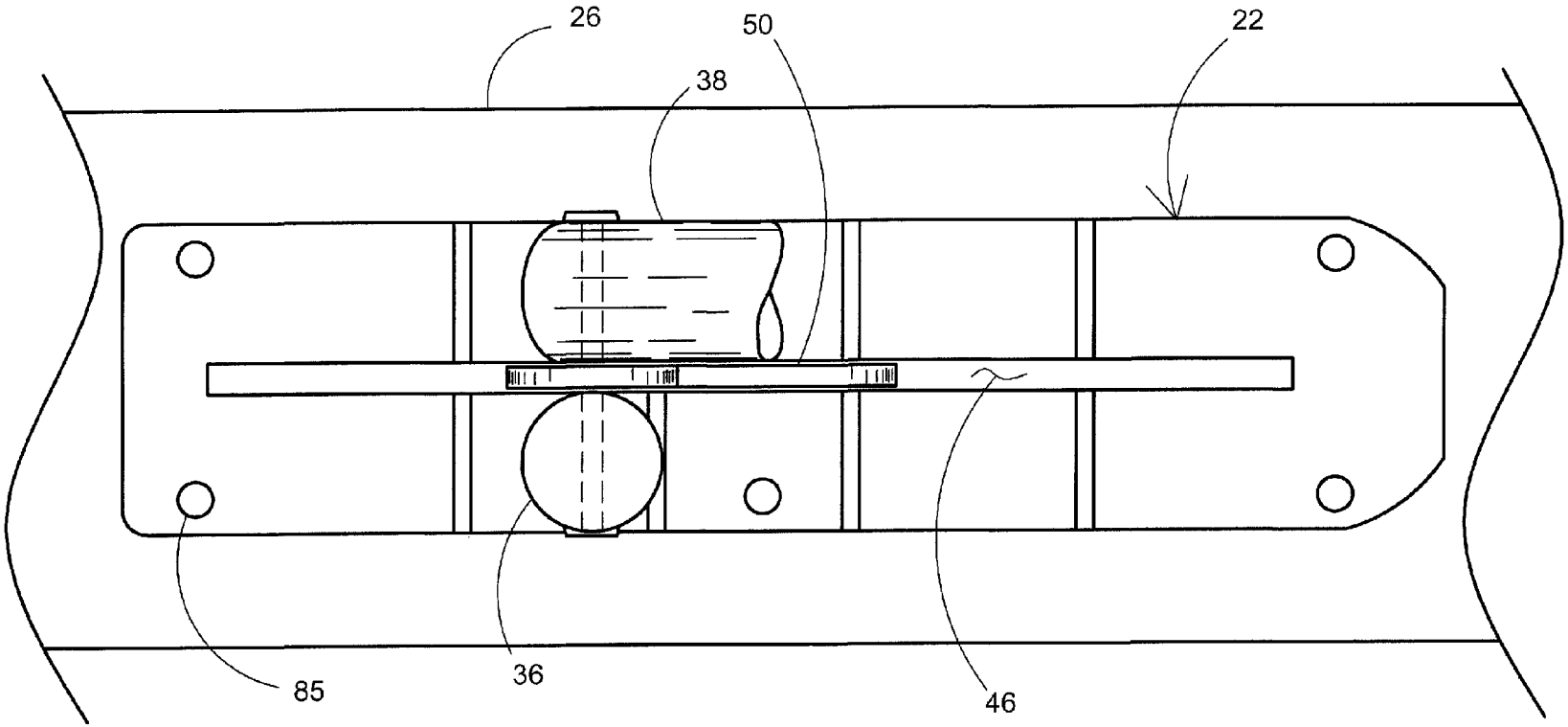
FIG. 5 diagrammatically illustrates a bottom view of the adjustment mechanism, the adjustment plate and the chair components.

FIG. 5 shows a bottom view wherein plate 50 closes the slot 46. Also, since the plate is a single, integral thin element, it is not possible for a finger of a user to be caught in thin, complementary slot 46.

Figure 6:
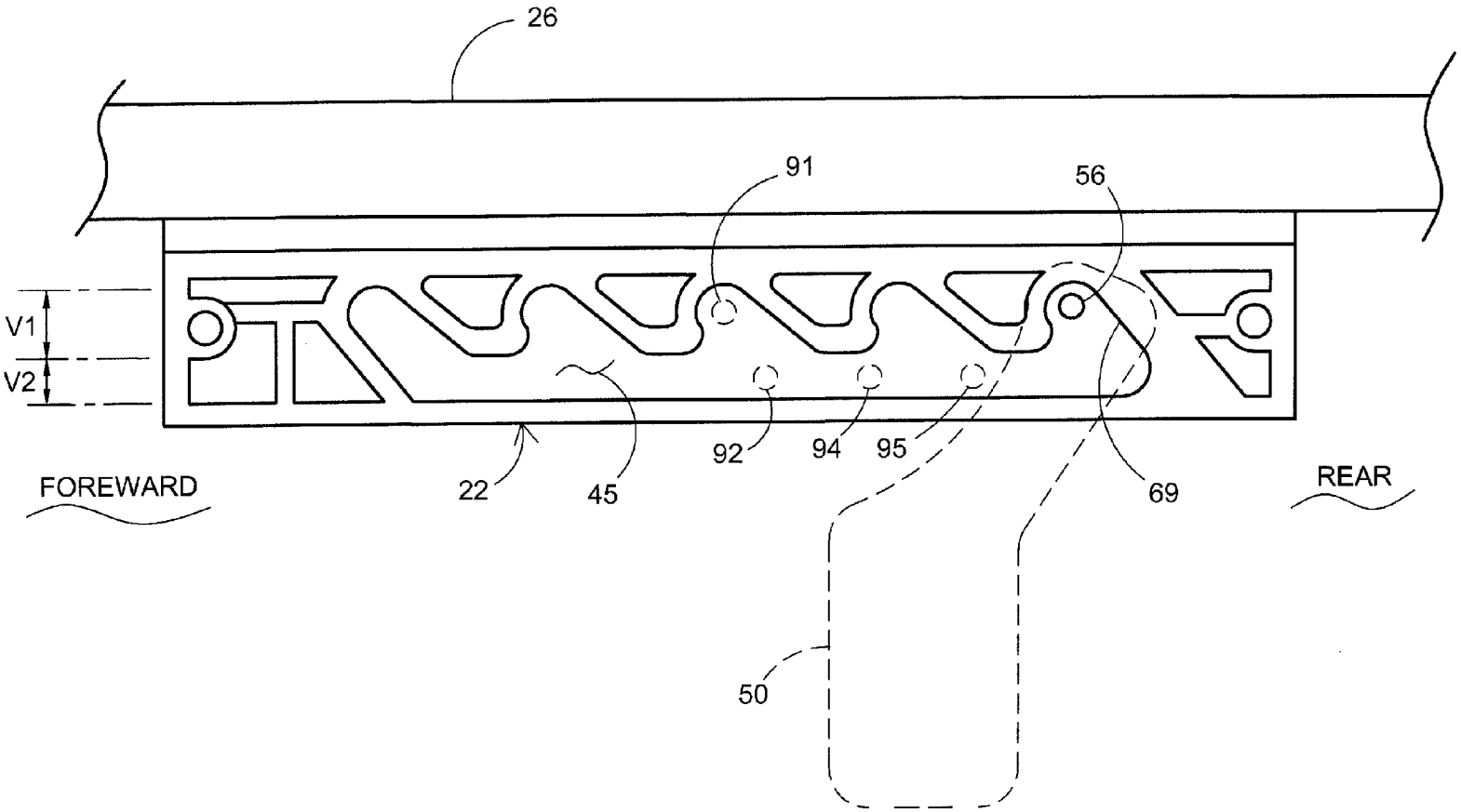
FIG. 6 diagrammatically illustrates movement from the first vertical position to the second vertical position and then to an initial folding chair position of the adjustment plate.

FIG. 6 shows plate movement, first in vertical space V1 from cam follower position 91 to position 92. Then plate 50 (and more precisely follower 56) moves in vertical space V2 from cam follower position 92 to position 94, then position 95. Ultimately, plate 50 is moved from vertical positional regions V2 to V1 and rests in the rearward region. The follower is guided by cam surface 69.

The user moves the chair arm with respect to the adjustment plate 50 by moving vertically from vertical space V1 into vertical space V2. This is the first vertical position to the second vertical position.

As illustrated in FIG. 6, the second position is 92 shown in dashed lines representing the position of cam follower 56 within closed space 45. The user then moves the chair arm or the chair leg to a rearward position longitudinally by keeping the cam follower 56 in vertical space V2. Therefore the cam follower moves from longitudinal position 92 to longitudinal position 94. By continuing the longitudinal movement to position 95, the user can then place the chair arm and cam follower 56 in the rearward most position shown in FIG. 6. If the user over shoots the rearward position, the forward facing angled cam section 69 guides the user to position cam follower 56 into the rearward most position.

Figure 7:
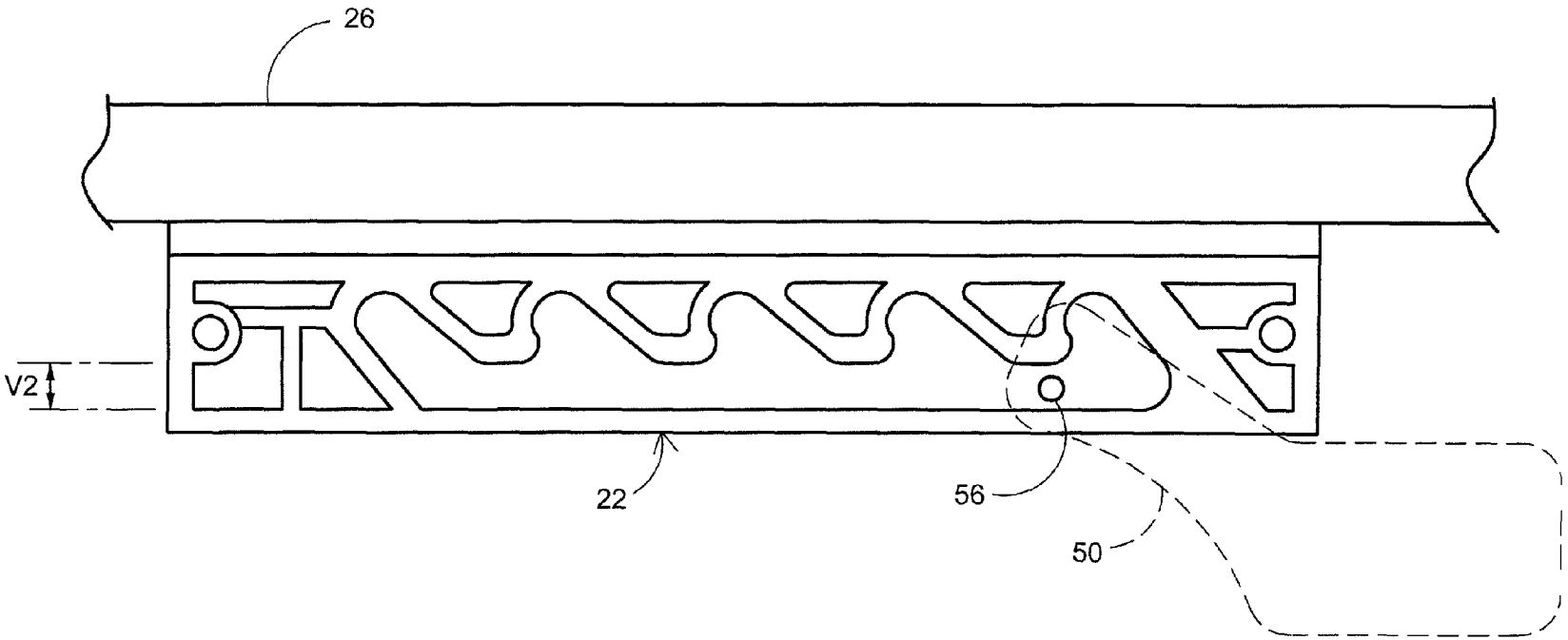
FIG. 7 diagrammatically illustrates the adjustment plate and the adjustment mechanism in a folded chair position.

FIG. 7 shows that the user is permitted to rotate the chair arm 26 with respect to the adjustment plate 50 when in the lower vertical region V2.

Figure 8:
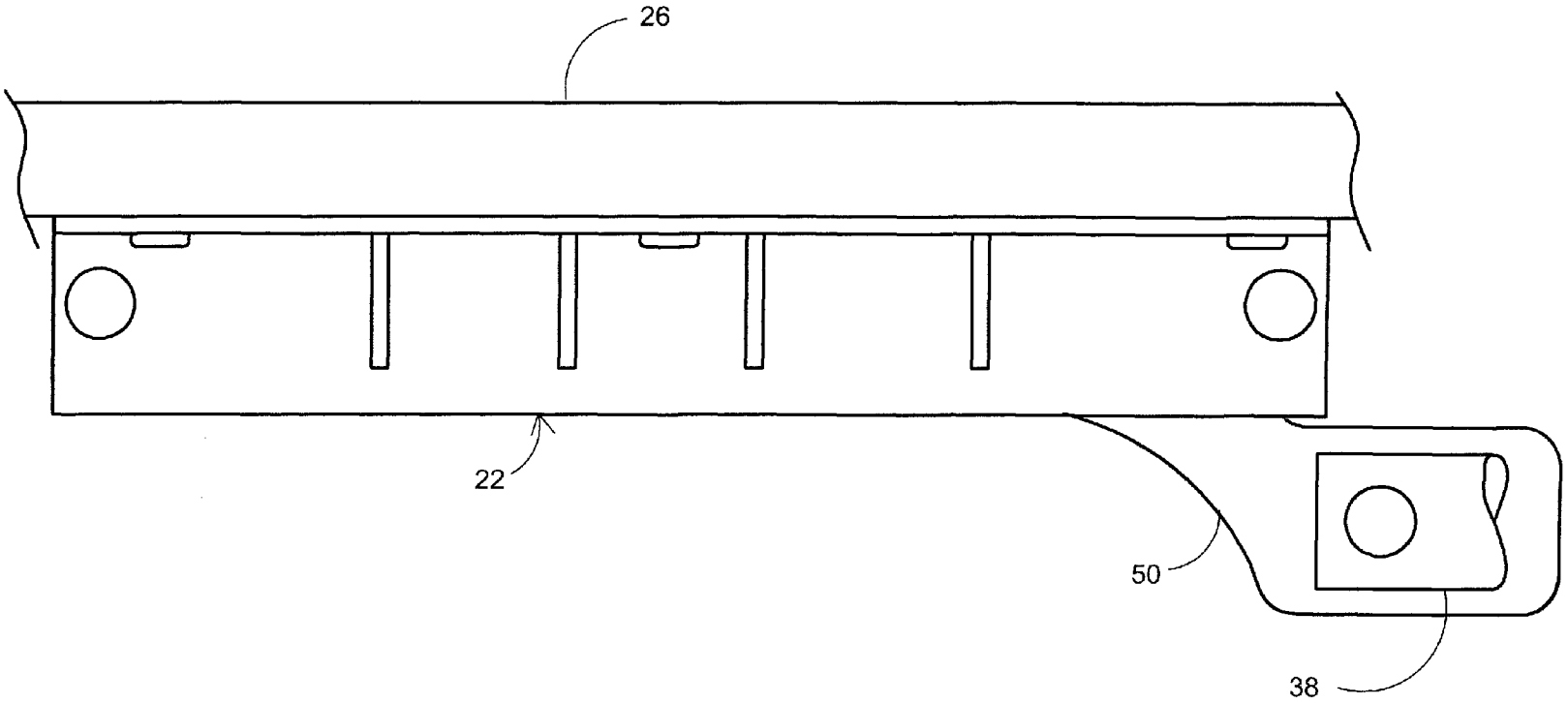
FIG. 8 diagrammatically illustrates the adjustment plate 50 in the folded chair position with a leg component of the folding chair.

FIG. 8 shows the chair in the folded position with the adjustment plate 50 and, more importantly, the lower plate region 54 being substantially parallel to both the housing for adjustment mechanism 22 and parallel to the plane established by the chair arm 26. Therefore, another advantage of adjustment mechanism 22 is ability to rotate the plate to a compact rotational position of chair legs 38, 36 with respect to the chair arm 26. The chair arm 26 is parallel to the chair legs 38, 36 and the lower region of the plate is also parallel to the chair arm 26.

Figure 9:
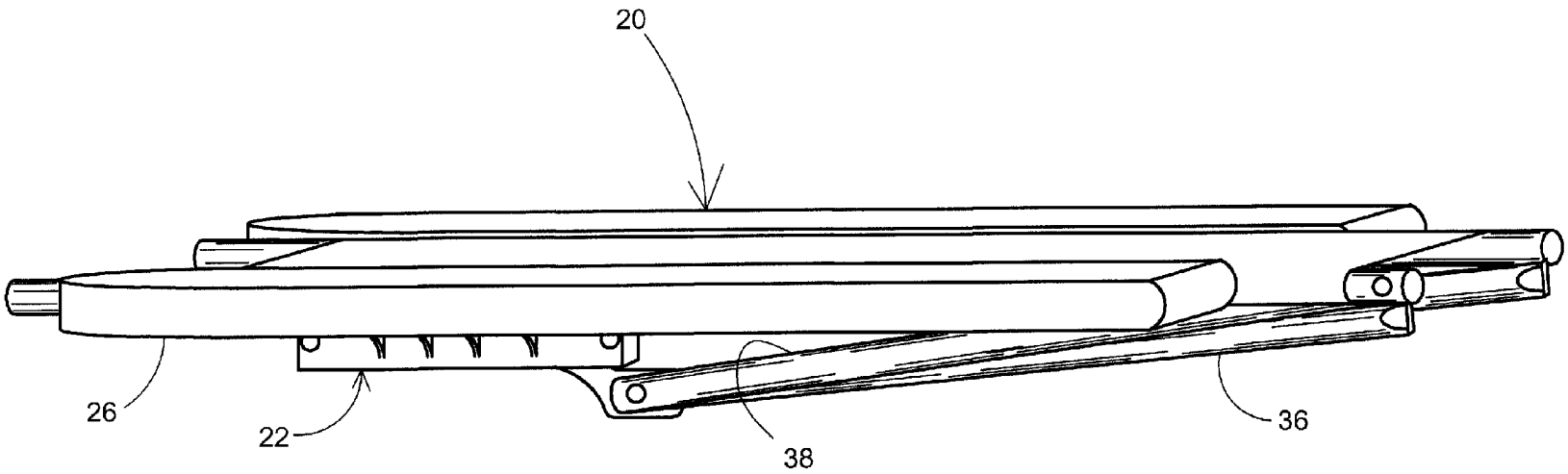
FIG. 9 diagrammatically illustrates a folded chair 20.

FIG. 9 shows chair 20 in a fully collapsed position. Chair arm 26 is shown with an adjustment mechanism 22 below it. Chair legs 36, 38 have been collapsed substantially parallel to the chair arm 26.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof, in particular, while the present chair adjustment mechanism has been described in the context of particularly preferred embodiments, the skilled artisan will appreciate, in view of the present disclosure, that certain advantages, features and aspects of the adjustment mechanism may be realized in a variety of other applications, many of which have been noted above. Additionally, it is contemplated that various aspects and features of the invention described can be practiced separately, combined together, or substituted for one another, and that a variety of combination and subcombinations of the features and aspects can be made and still fall within the scope of the invention. Thus, it is intended that the scope of the present invention herein disclosed should not be limited by the particular disclosed embodiments described above, but should be determined only by a fair reading of the claims.

The invention claimed is:

1. An adjustment mechanism for a chair which adjustment mechanism is attached beneath a chair arm rest, comprising:

a housing attached beneath the chair arm rest, the housing having a forward wall, a rearward wall and a pair of opposing side walls extending between the forward and rear walls and a bottom wall which collectively define, in conjunction with the chair arm rest, an interior closed space;

the bottom wall having a single guide slot therein extending longitudinally in the housing and having a predetermined lateral slot width;

said housing, defining in said interior closed space, a longitudinal continuous serpentine adjustment surface having at least first and second longitudinally spaced adjustment surface segments, the serpentine adjustment surface defines a cam surface for a cam follower on an adjustment plate which adjustment plate movably extends through said guide slot;

said adjustment plate having an upper plate region extending into said interior closed space and a lower plate region extending below the bottom wall of said housing, the upper and lower adjustment plate regions being planar with a thickness complementary to said guide slot lateral width such that the adjustment plate substantially closes the guide slot thereat;

said cam follower formed in the upper plate region which moves over the serpentine cam surface as the adjustment plate moves longitudinally within the interior closed space;

said lower plate region extends outward from said guide slot and is configured to be attachable to a component of the chair;

wherein the adjustment plate is movable between a first vertical position and a second vertical position relative to the housing, in the first vertical position the adjustment plate is able to move in the longitudinal direction from one side of the serpentine cam surface to the other side of the serpentine cam surface, in the second vertical position the cam follower on the adjustment plate is able to engage either one of the first and second adjustment surface segments to selectively adjust a longitudinal position of the adjustment plate relative to the housing.

2. An adjustment mechanism for a chair as claimed in claim 1 wherein the serpentine adjustment surface which includes a plurality of depending rounded cam ridges, each cam ridge having a rearward-facing substantially vertical cam ridge section and a forward-facing angled cam ridge section such that release of said adjustment plate and cam follower from an intersection of a respective angled cam ridge section and an adjacent vertical cam ridge section requires adjustment plate movement between the first vertical position and the second vertical position.

3. An adjustment mechanism for a chair as claimed in claim 2 wherein each intersection between the respective angled cam ridge section and the adjacent vertical cam ridge section defines a rounded cam ridge rest section.

4. An adjustment mechanism for a chair as claimed in claim 3 wherein each of said first and said second adjustment surface segments are respectively formed by:

a respective rearward-facing substantially vertical cam ridge section, the corresponding intersection and the corresponding adjacent angled cam ridge section.

5. An adjustment mechanism for a chair as claimed in claim 4 wherein each said angled cam ridge section defines an acute angle with respect to one or more vertical cam ridge sections.

6. An adjustment mechanism for a chair as claimed in claim 5 wherein a forward-most angled cam ridge terminates in a rearward-facing loop cam surface.

7. An adjustment mechanism for a chair as claimed in claim 6 wherein the terminal rearward-facing loop cam surface forms a complementary angled cam surface, complementary to the adjacent angled cam ridge section.

8. An adjustment mechanism for a chair as claimed in claim 7 wherein said bottom wall of said housing defines a lower cam surface limiting said cam follower when the plate moves longitudinally while in said first vertical position.

9. An adjustment mechanism for a chair as claimed in claim 2 wherein a forward-most angled cam ridge terminates in a rearward-facing loop cam surface.

10. An adjustment mechanism for a chair as claimed in claim 2 wherein each of said first and said second adjustment surface segments are respectively formed by:

a respective rearward-facing substantially vertical cam ridge section, the corresponding intersection and the corresponding adjacent angled cam ridge section.

11. An adjustment mechanism for a chair as claimed in claim 2 wherein each said angled cam ridge section defines an acute angle with respect to one or more vertical cam ridge sections.

12. An adjustable chair, comprising a stationary portion and an adjustable portion that is adjustable relative to the stationary portion, wherein the stationary portion comprises a frame portion and the adjustable portion comprises a backrest portion and an armrest portion, the chair further comprising an adjustment mechanism that permits adjustment of the adjustable portion into a selected one of at least two adjustment positions defined by respective cam surfaces, the adjustment mechanism having:

a housing attached beneath the armrest portion, the housing having a forward wall, a rearward wall and a pair of opposing side walls extending between the forward and rear walls and a bottom wall which collectively define, in conjunction with the armrest portion, an interior closed space;

the bottom wall having a single guide slot therein extending longitudinally in the housing and having a predetermined lateral slot width;

said housing, defining in said interior closed space, a longitudinal continuous serpentine adjustment surface defining the at least two adjustment positions longitudinally spaced apart as adjustment surface segments, the serpentine adjustment surface defines a cam surface for a cam follower on an adjustment plate which adjustment plate movably extends through said guide slot;

said adjustment plate having an upper plate region extending into said interior closed space and a lower plate region extending below the bottom wall of said housing, the upper and lower adjustment plate regions being planar with a thickness complementary to said guide slot lateral width such that the adjustment plate substantially closes the guide slot thereat;

said cam follower formed in the upper plate region which moves over the serpentine cam surface as the adjustment plate moves longitudinally within the interior closed space;

said lower plate region extends outward from said guide slot and is configured to be attachable to the stationary portion of the chair;

wherein the adjustment plate is movable between a first vertical position and a second vertical position relative to the housing, in the first vertical position the adjustment plate is able to move in the longitudinal direction from one side of the serpentine cam surface to the other side of the serpentine cam surface, in the second vertical position the cam follower on the adjustment plate is able to engage either one of the first and second adjustment surface segments to selectively adjust a longitudinal position of the adjustment plate relative to the housing to the at least two adjustment positions.

13. An adjustable chair as claimed in claim 12 wherein the serpentine adjustment surface which includes a plurality of depending rounded cam ridges, each cam ridge having a rearward-facing substantially vertical cam ridge section and a forward-facing angled cam ridge section such that release of said adjustment plate and cam follower from an intersection of a respective angled cam ridge section and an adjacent vertical cam ridge section requires adjustment plate movement between the first vertical position and the second vertical position.

14. An adjustable chair as claimed in claim 13 wherein each intersection between the respective angled cam ridge section and the adjacent vertical cam ridge section defines a rounded cam ridge rest section.

15. An adjustable chair as claimed in claim 14 wherein each of said first and said second adjustment surface segments are respectively formed by:

a respective rearward-facing substantially vertical cam ridge section, the corresponding intersection and the corresponding adjacent angled cam ridge section.

16. An adjustable chair as claimed in claim 15 wherein each said angled cam ridge section defines an acute angle with respect to one or more vertical cam ridge sections.

17. An adjustable chair as claimed in claim 16 wherein a forward-most angled cam ridge terminates in a rearward-facing loop cam surface.

18. An adjustable chair as claimed in claim 17 wherein the terminal rearward-facing loop cam surface forms a complementary angled cam surface, complementary to the adjacent angled cam ridge section.

19. An adjustable chair as claimed in claim 18 wherein said bottom wall of said housing defines a lower cam surface limiting said cam follower when the plate moves longitudinally while in said first vertical position.

20. An adjustable chair as claimed in claim 13 wherein a forward-most angled cam ridge terminates in a rearward-facing loop cam surface.

21. An adjustable chair as claimed in claim 13 wherein each of said first and said second adjustment surface segments are respectively formed by:

a respective rearward-facing substantially vertical cam ridge section, the corresponding intersection and the corresponding adjacent angled cam ridge section.

22. An adjustable chair as claimed in claim 13 wherein each said angled cam ridge section defines an acute angle with respect to one or more vertical cam ridge sections.

* * * * *